US012059043B2

(12) United States Patent
Sorokina

(10) Patent No.: US 12,059,043 B2
(45) Date of Patent: Aug. 13, 2024

(54) WIRELESS BRASSIERE

(71) Applicant: Svetlana Sorokina, Encino, CA (US)

(72) Inventor: Svetlana Sorokina, Encino, CA (US)

( * ) Notice: Subject to any disclaimer, the term of this patent is extended or adjusted under 35 U.S.C. 154(b) by 90 days.

(21) Appl. No.: 17/315,203

(22) Filed: May 7, 2021

(65) Prior Publication Data

US 2021/0401070 A1 Dec. 30, 2021

Related U.S. Application Data

(60) Provisional application No. 63/021,551, filed on May 7, 2020.

(51) Int. Cl.
*A41C 3/00* (2006.01)
*A41C 3/10* (2006.01)
*A41C 3/12* (2006.01)

(52) U.S. Cl.
CPC ..... *A41C 3/0057* (2013.01); *A41C 3/0007* (2013.01); *A41C 3/0021* (2013.01); *A41C 3/10* (2013.01); *A41C 3/128* (2013.01)

(58) Field of Classification Search
CPC ..... A41C 3/0021
See application file for complete search history.

(56) References Cited

U.S. PATENT DOCUMENTS 2,971,514 A * 2/1961 Steinmetz ..... A41C 3/00 450/74
3,186,412 A * 6/1965 Kurland ..... A41C 3/00 450/86
3,537,279 A * 11/1970 Epley ..... D04B 1/246 66/189
2006/0048547 A1* 3/2006 Duckham ..... A41C 3/0014 66/176
2010/0035514 A1* 2/2010 Wong ..... A41C 3/0035 450/55
2011/0300774 A1* 12/2011 Smith ..... A41C 5/00 112/475.09
2019/0116890 A1* 4/2019 Poirier ..... A41C 1/06
2019/0387813 A1* 12/2019 Almog ..... A41C 5/00
2020/0037673 A1* 2/2020 Storelli ..... A41C 3/0057

* cited by examiner

*Primary Examiner* — Jocelyn Bravo
(74) *Attorney, Agent, or Firm* — Sheppard, Mullin, Richter & Hampton LLP

(57) ABSTRACT

A brassiere design that is wireless, that reduces uncomfortable rubbing and chafing of the breasts, and that provides sufficient lift to the breasts to give comfort to the wearer. The brassiere design may comprise left and right cups that are configured as socks for the breasts of the wearer, each of the socks defining a recess into which one of the breasts of the wearer can be received. Each of the socks acts as a stretchable sling or pocket to suspend and hold a breast, and to shape the breast into an attractive teardrop shape.

18 Claims, 10 Drawing Sheets

WIRELESS BRASSIERE

CROSS-REFERENCE TO RELATED APPLICATION

This application claims the benefit of U.S. Provisional Application No. 63/021,551, filed on May 7, 2021, which is incorporated herein by reference in its entirety.

TECHNICAL FIELD

The disclosed technology relates generally to undergarments, and more particularly, some embodiments relate to a wireless brassiere.

DESCRIPTION OF THE RELATED ART

Many existing designs for brassieres push the breasts of the wearer together, which can cause uncomfortable rubbing and chafing of the breasts. Additionally, to provide support for the breasts, many existing brassiere designs comprise a wire placed in the periphery of the cups of the undergarment, which can also cause discomfort to the wearer.

There is a need for a brassiere design that is wireless, that reduces the uncomfortable rubbing and chafing of the breasts, and that provides sufficient lift to the breasts to give comfort to the wearer. Embodiments of the disclosed technology satisfy this need and other needs.

BRIEF SUMMARY OF EMBODIMENTS

According to various embodiments of the disclosed technology, there is disclosed a brassiere design that is wireless, that reduces the uncomfortable rubbing and chafing of the breasts, and that provides sufficient lift to the breasts to give comfort to the wearer.

In one embodiment, the brassiere design comprises left and right cups that are configured as socks for the breasts of the wearer, each of the socks defining a recess into which one of the breasts of the wearer can be received. Each of the socks acts as a stretchable sling or pocket to suspend and hold a breast, and to shape the breast into an attractive teardrop shape. The socks may be configured to separate the breasts of the wearer and to individually lift the breasts of the wearer in order to reduce sagginess and to provide for individual movement of each breast. The socks may comprise an elastic fabric, such as nylon or spandex. In a particular embodiment, the elastic fabric of the socks has a straight grain that is oriented vertically to assist in lifting the breasts of the wearer, although other orientations of the grain are within the scope of this disclosure. In other embodiments, the grain of the elastic fabric may be oriented in a direction other than vertical.

According to an embodiment of the disclosed technology, there is disclosed an undergarment comprising an underband, left and right wings, left and right shoulder straps, and left and right cups.

In one embodiment, the undergarment is wireless.

In one embodiment, the underband comprises a left underband portion and a right underband portion. Each of the left underband portion and the right underband portion has a gore end and a closure end. The gore end of the left underband portion and the gore end of the right underband portion meet at a gore area of the undergarment. The closure end of the left underband portion and closure end of the right underband portion are configured to be releasably fastened together on a back side of a wearer of the undergarment.

In one embodiment, a bottom edge of the left underband portion bends upwardly in a region beneath the left cup. A bottom edge of the right underband portion bends upwardly in a region beneath the right cup. A bottom edge of the underband forms a "V" shape in the gore area of the undergarment.

In one embodiment, each of the left and right wings comprises an underarm portion and a back portion. A bottom edge of the underarm portion of the left wing is attached to a top edge of the left underband portion between the gore end of the left underband portion and the closure end of the left underband portion. A bottom edge of the underarm portion of the right wing is attached to a top edge of the right underband portion between the gore end of the right underband portion and the closure end of the right underband portion. The back portion of the left wing and the back portion of the right wing are configured to be releasably fastened together on the back side of the wearer of the undergarment.

In one embodiment, the back portion of the left wing extends at an angle from the underarm portion of the left wing, forming an acute angle with the left underband portion. The back portion of the right wing extends at an angle from the underarm portion of the right wing, forming an acute angle with the right underband portion. A gap is defined between the left and right underband portions, on the one hand, and the back portions of the left and right wings, on the other hand.

In one embodiment, each of the left and right shoulder straps has a back end and a chest portion. The back end of the left shoulder strap is attached to a top edge of the back portion of the left wing. The back end of the right shoulder strap is attached to a top edge of the back portion of the right wing.

In one embodiment, the underband, the left and right wings, and the left and right shoulder straps comprise a breathable fabric.

In one embodiment, the chest portion of the left shoulder strap has a left extension attached to and extending along a neckline edge of the left cup. The chest portion of the right shoulder strap has a right extension attached to and extending along a neckline edge of the right cup. The left extension and the right extension both extend into the gore area of the undergarment. A bottom end of the left extension is attached to the right underband portion in the gore area of the undergarment. A bottom end of the right extension is attached to the left underband portion in the gore area of the undergarment. The left extension and the right extension cross in the gore area of the undergarment.

In one embodiment, the left extension and the right extension both comprise an elastic material.

In one embodiment, each of the left and right cups has a bottom edge, a side edge, and a neckline edge. The bottom edge of the left cup is attached to the top edge of the left underband portion. The bottom edge of the right cup is attached to the top edge of the right underband portion. The side edge of the left cup is attached to a front end of the underarm portion of the left wing. The side edge of the right cup is attached to a front end of the underarm portion of the right wing. The neckline edge of the left cup is attached to the chest portion of the left shoulder strap. The neckline edge of the right cup is attached to the chest portion of the right shoulder strap.

In one embodiment, the left and right cups are configured as socks for the breasts of the wearer, each of the socks defining a recess into which one of the breasts of the wearer can be received. Each of the socks acts as a sling to suspend a breast.

In one embodiment, the socks are configured to separate the breasts of the wearer.

In one embodiment, the socks are configured to individually lift the breasts of the wearer to reduce sagginess and to provide for individual movement of each breast.

In one embodiment, the socks are configured to compress and shape the breasts of the wearer.

In one embodiment, the socks comprise an elastic fabric.

In one embodiment, the elastic fabric is nylon.

In one embodiment, the elastic fabric is spandex. In another embodiment, the elastic fabric is a textile having some spandex in it.

In one embodiment, the elastic fabric of the socks has a straight grain. The straight grain of the elastic fabric is oriented vertically to assist in lifting the breasts of the wearer. In another embodiment, the elastic fabric of the socks has a four-way stretch.

In one embodiment, the elastic fabric of each of the socks comprises a first outwardly curved edge, a second outwardly curved edge extending at an angle less than 180 degrees from the first outwardly curved edge, a third outwardly curved edge extending at an angle greater than 180 degrees from the second outwardly curved edge, and one or more substantially straight edges connecting the third outwardly curved edge to the first outwardly curved edge. The first outwardly curved edge and the second outwardly curved edge are substantially equal in length and are at least partially sewn together to create a seam. The seam extends from a central portion to the neckline edge of one of the left or right cups.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE FIGURES

The technology disclosed herein, in accordance with one or more various embodiments, is described in detail with reference to the following figures. The figures are provided for purposes of illustration only and merely depict typical or example embodiments of the disclosed technology. These figures are provided to facilitate the reader's understanding of the disclosed technology and shall not be considered limiting of the breadth, scope, or applicability thereof.

Figure 1:
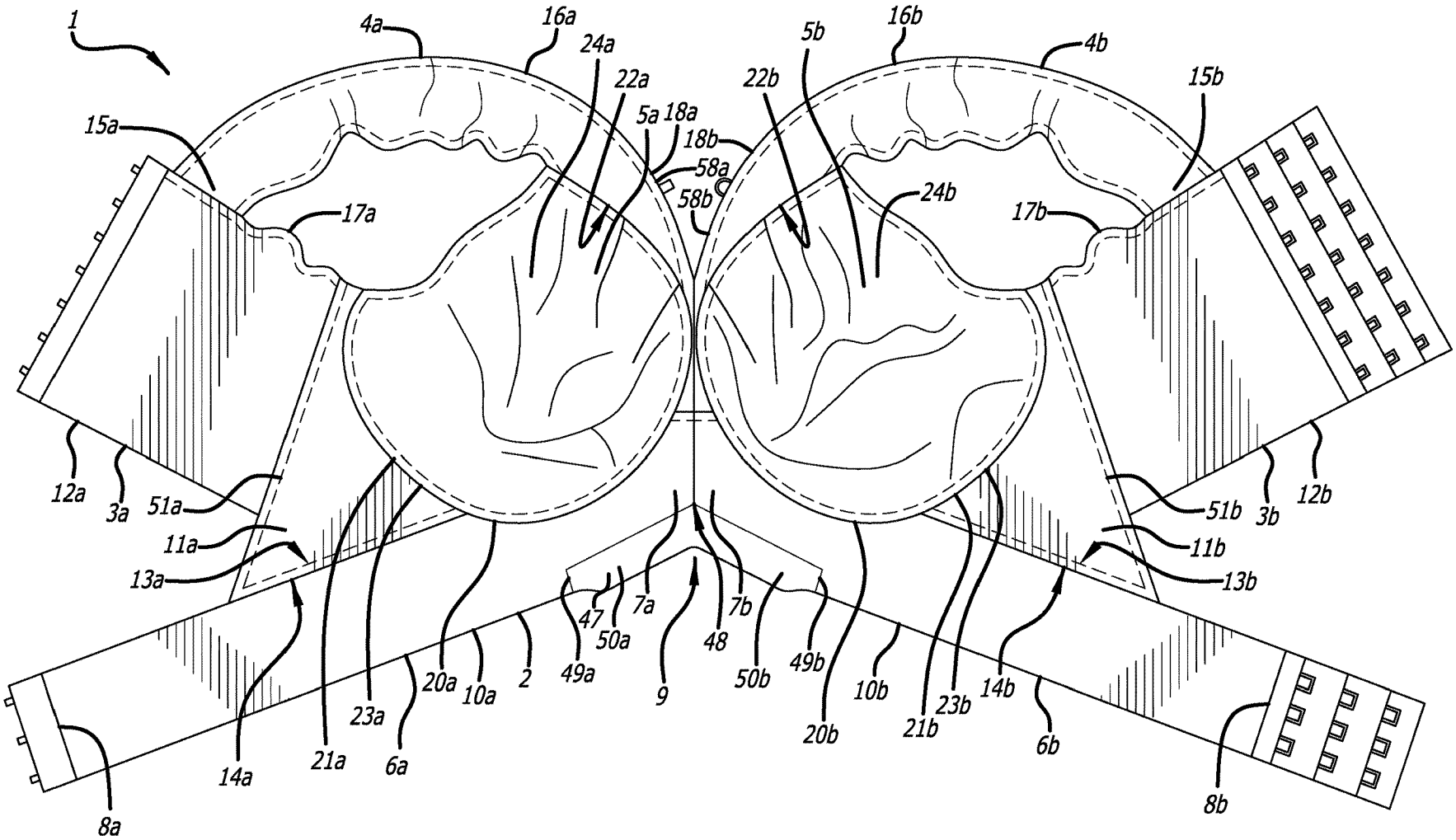
FIG. 1 is a front view of an undergarment in accordance with one embodiment of the technology described herein, depicted with left and right underband portions unfastened and laid flat, and with left and right wings unfastened and laid flat.

The figures are not exhaustive and do not limit the disclosure or the disclosed embodiments to the precise form disclosed.

DETAILED DESCRIPTION OF THE EMBODIMENTS

Embodiments of the technology disclosed herein are directed toward undergarments. More particularly, the various embodiments of the technology disclosed herein relate to a wireless brassiere.

With reference to FIGS. 1-8, there is shown an undergarment 1 according to an embodiment of the disclosed technology. The undergarment 1 comprises an underband 2, left and right wings 3*a* and 3*b*, left and right shoulder straps 4*a* and 4*b*, and left and right cups 5*a* and 5*b*. As shown in FIGS. 1-8, the undergarment 1 is wireless.

In one embodiment, the underband 2 comprises a left underband portion 6*a* and a right underband portion 6*b*. Each of the left underband portion 6*a* and the right underband portion 6*b* has a gore end 7*a*/7*b* and a closure end 8*a*/8*b*. The gore end 7*a* of the left underband portion 6*a* and the gore end 7*b* of the right underband portion 6*b* meet at a gore area 9 of the undergarment 1. The closure end 8*a* of the left underband portion 6*a* and closure end 8*b* of the right underband portion 6*b* are configured to be releasably fastened together on a back side of a wearer of the undergarment 1.

In one embodiment, a bottom edge 10*a* of the left underband portion 6*a* bends upwardly in a region beneath the left cup 5*a*. A bottom edge 10*b* of the right underband portion 6*b* bends upwardly in a region beneath the right cup 5*b*. The bottom edges 10*a* and 10*b* of the underband 2 form a "V" shape in the gore area 9 of the undergarment 1.

As shown for example in FIGS. 1-4, the "V" shape in the gore area 9 of the undergarment 1 is reinforced using a reinforcement 47 sewn into the left underband portion 6*a* and the right underband portion 6*b* adjacent the bottom edges 10*a* and 10*b*. The reinforcement 47 may comprise metal, plastic, or another rigid or partially rigid material.

The reinforcement 47 may be chevron-shaped, as shown in the embodiment of FIGS. 1-6, or another shape that helps to maintain the "V" shape in the gore area 9 of the undergarment 1. Instead of the top 48 of the chevron shape being pointed, the top of the chevron shape may be chamfered. The left end 49*a* and the right end 49*b* of the chevron shape may be rounded.

The reinforcement 47 may comprise a left reinforcing portion 50*a* sewn into the left underband portion 6*a* and a right reinforcing portion 50*b* sewn into the right underband portion 6*b*, with the left reinforcing portion 50*a* and the right reinforcing portion 50*b* attached at the middle of the underband 2. The left reinforcing portion 50*a* and the right reinforcing portion 50*b* help to keep the "V" shape in the gore area 9 from stretching out into a straight line.

In one embodiment, each of the left and right wings 3*a* and 3*b* comprises an underarm portion 11*a*/11*b* and a back portion 12*a*/12*b*. A bottom edge 13*a* of the underarm portion 11*a* of the left wing 3*a* is attached to a top edge 14*a* of the left underband portion 6*a* between the gore end 7*a* of the left underband portion 6*a* and the closure end 8*a* of the left underband portion 6*a*. A bottom edge 13*b* of the underarm portion 11*b* of the right wing 3*b* is attached to a top edge 14*b* of the right underband portion 6*b* between the gore end 7*b* of the right underband portion 6*b* and the closure end 8*b* of the right underband portion 6*b*. The back portion 12*a* of the left wing 3*a* and the back portion 12*b* of the right wing 3*b* are configured to be releasably fastened together on the back side of the wearer of the undergarment 1.

Figure 2:
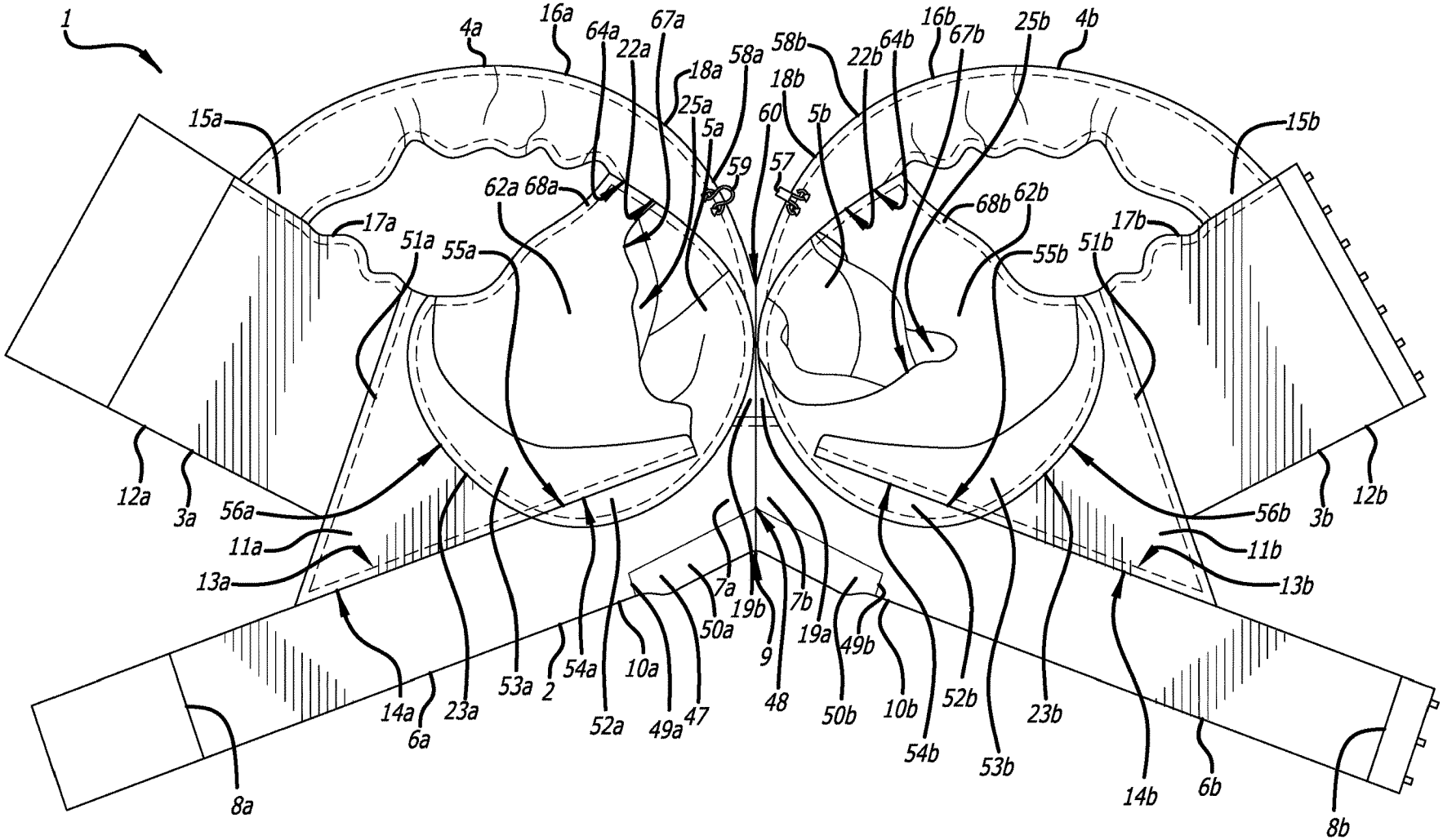
FIG. 2 is a rear view of the undergarment of FIG. 1, depicted with left and right underband portions unfastened and laid flat, and with left and right wings unfastened and laid flat.
Figure 3:
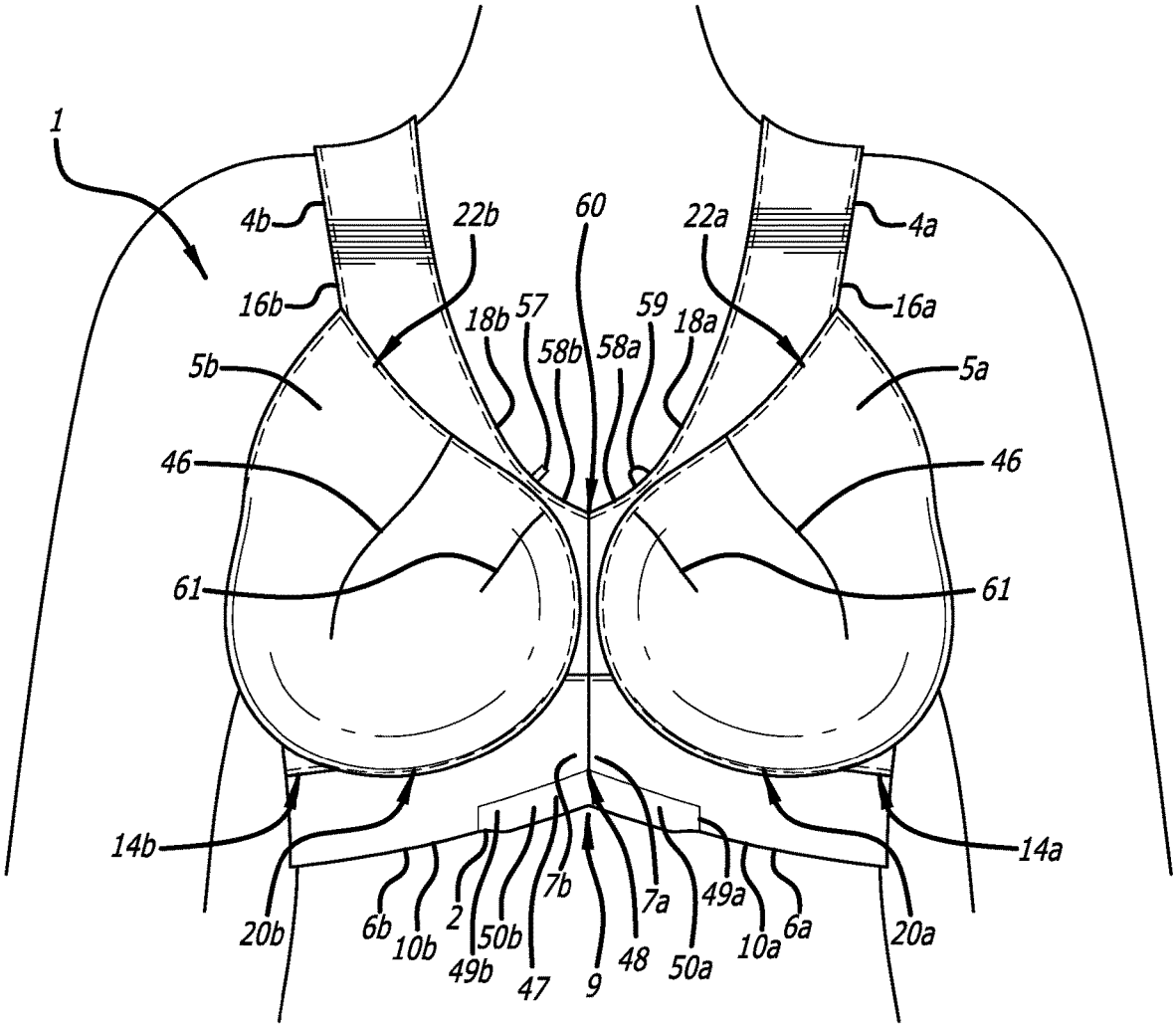
FIG. 3 is a front elevational view of the undergarment of FIG. 1, depicted as worn by a model, with the chest-portion hook-and-eye left open.
Figure 4:
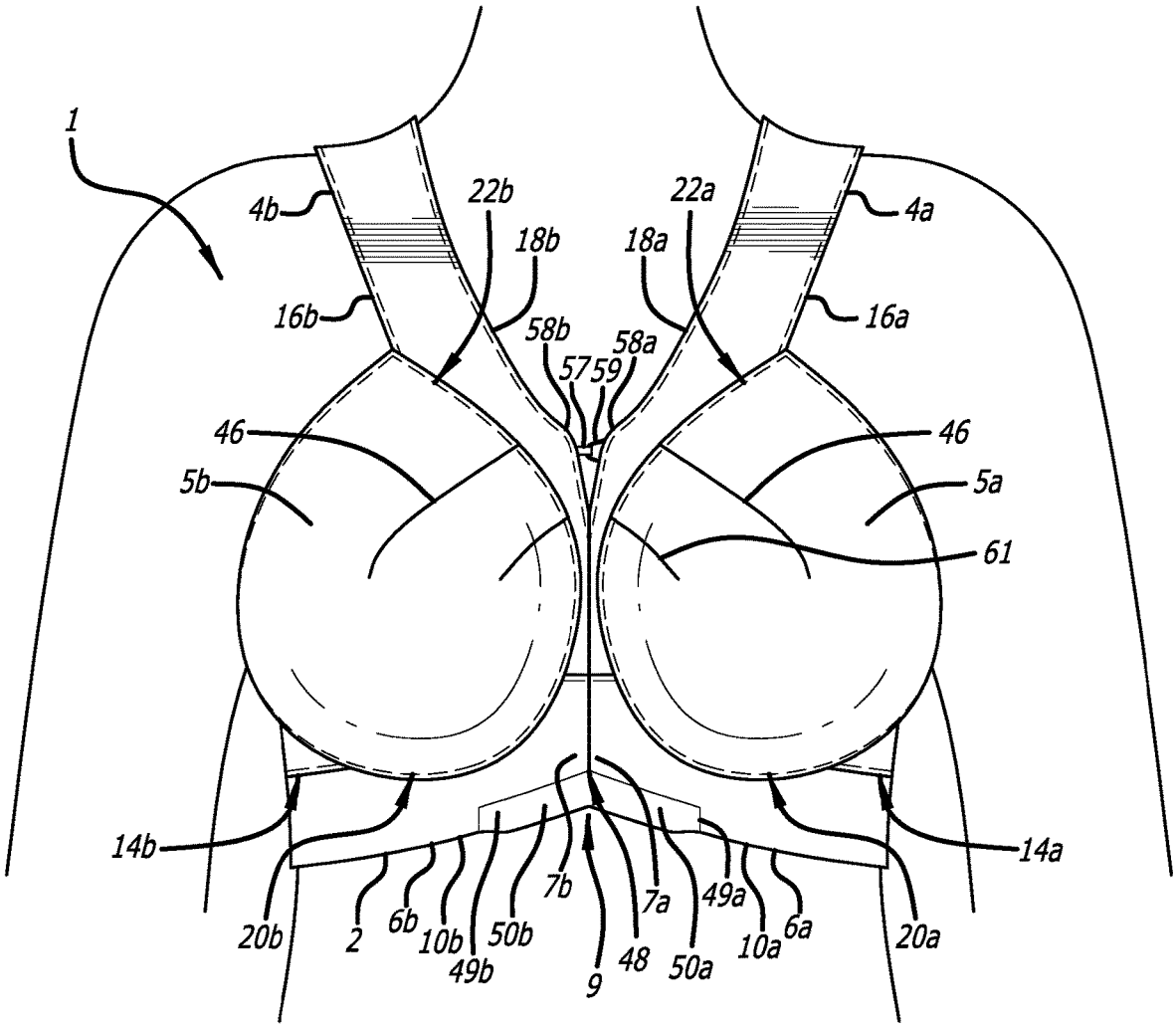
FIG. 4 is a front elevational view of the undergarment of FIG. 1, depicted as worn by a model, with the chest-portion hook-and-eye closed.
Figure 5:
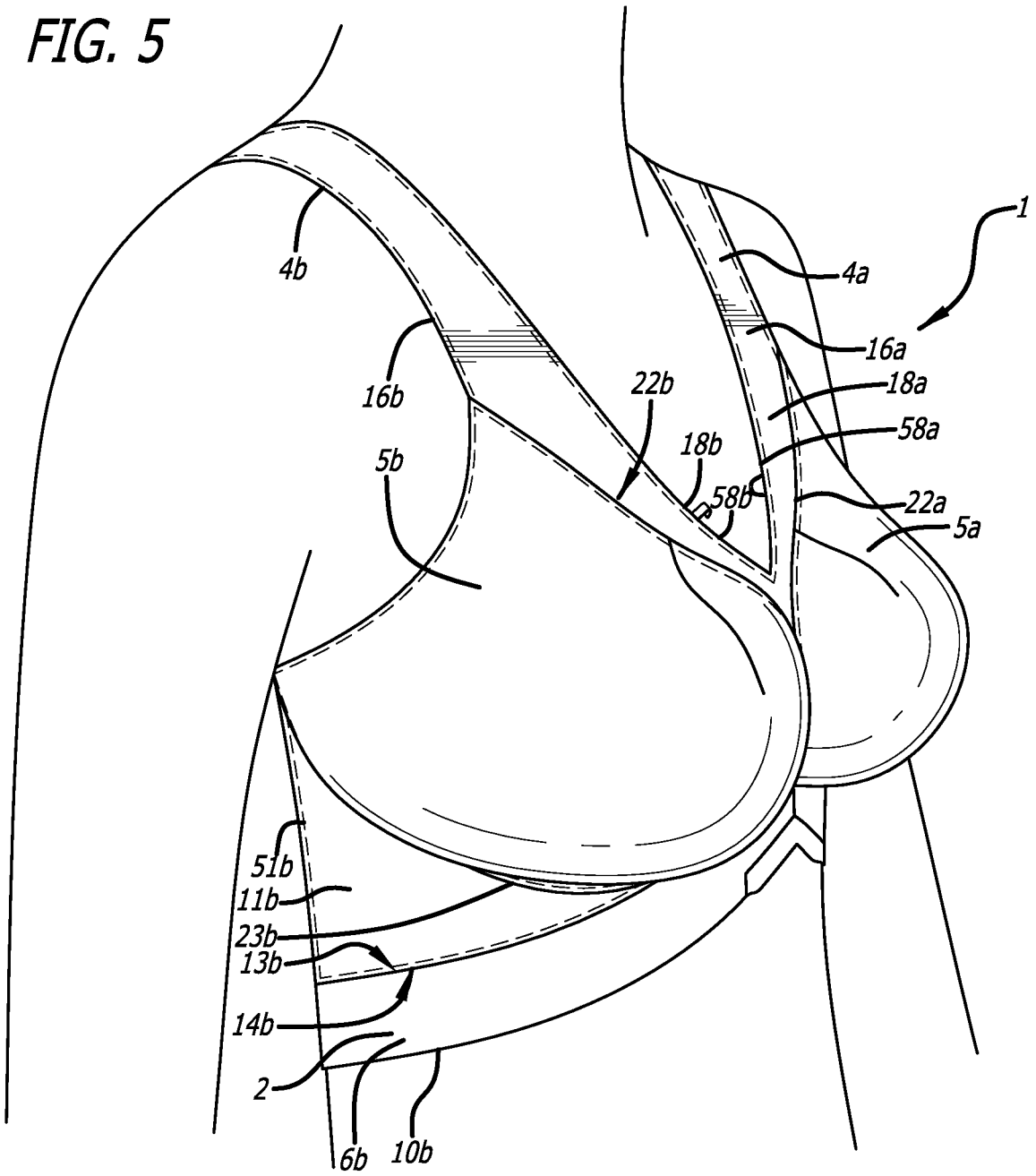
FIG. 5 is a front-right elevational view of the undergarment of FIG. 1, depicted as worn by a model, with the chest-portion hook-and-eye left open.
Figure 6:
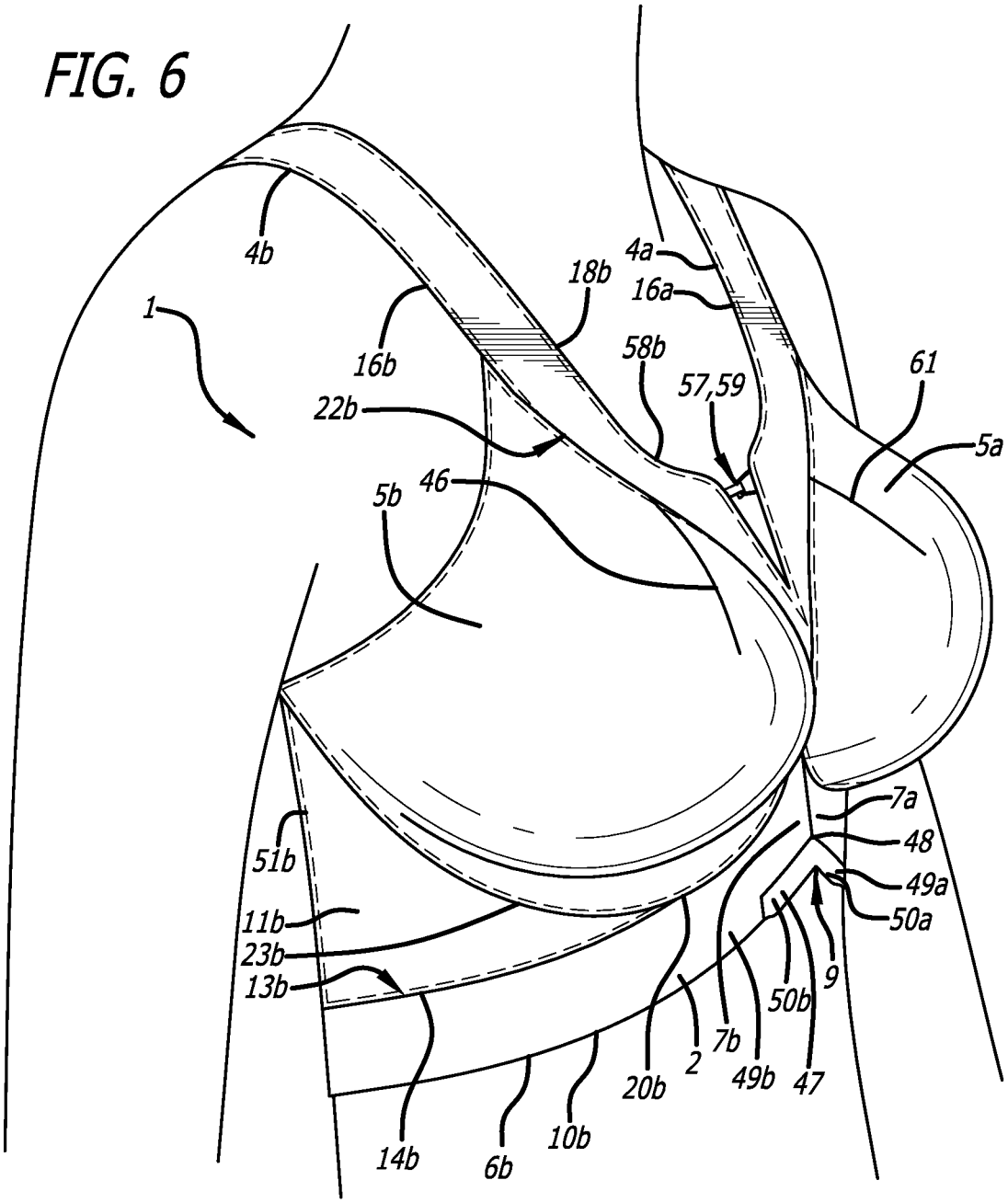
FIG. 6 is a front-right elevational view of the undergarment of FIG. 1, depicted as worn by a model, with the chest-portion hook-and-eye closed.
Figure 7:
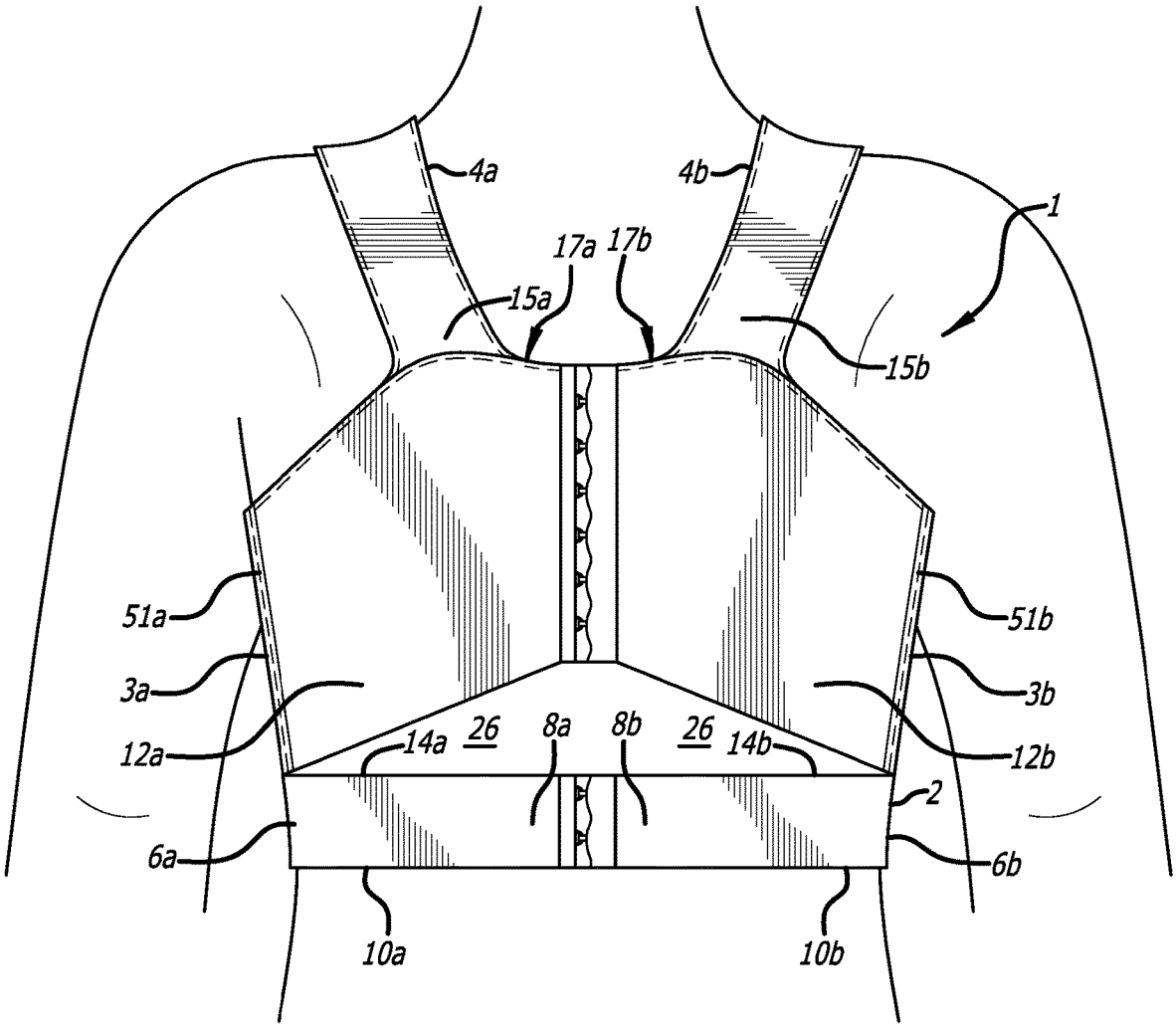
FIG. 7 is a rear elevational view of the undergarment of FIG. 1, depicted as worn by a model.

As shown for example in FIGS. 1 and 2, the underarm portions 11*a* and 11*b* have a generally triangular shape and are respectively stitched at seam lines 51*a* and 51*b* to the back portions 12*a* and 12*b*. This two-piece construction was found to sit better on the wearer's body than a one-piece construction. The back portion 12*a* of the left wing 3*a* extends at substantially a right angle from the underarm portion 11*a* of the left wing 3*a*. The back portion 12*b* of the left wing 3*b* extends at substantially a right angle from the underarm portion 11*b* of the left wing 3*b*. Because the seam lines 51*a* and 51*b* are angled with respect to the top edges 14*a* and 14*b* of the left and right underband portions 6*a* and 6*b*, the back portions 12*a* and 12*b* are respectively angled away from the left and right underband portions 6*a* and 6*b* so that a gap 26 is defined between the left and right underband portions 6*a* and 6*b*, on the one hand, and the back portions 12*a* and 12*b*, on the other hand.

In other embodiments, the underarm portions 11*a* and 11*b* can have a one-piece construction with the back portions 12*a* and 12*b*. In a one-piece construction, the back portion 12*a* of the left wing 3*a* can extend at an angle from the underarm portion 11*a* of the left wing 3*a*, forming an acute angle with the left underband portion 6*a*. The back portion 12*b* of the right wing 3*b* can extend at an angle from the underarm portion 11*b* of the right wing 3*b*, forming an acute angle with the right underband portion 6*b*. A gap 26 is thus defined between the left and right underband portions 6*a* and 6*b*, on the one hand, and the back portions 12*a* and 12*b* of the left and right wings 3*a* and 3*b*, on the other hand.

As shown for example in FIGS. 1 and 2, each of the left and right shoulder straps 4*a* and 4*b* has a back end 15*a*/15*b* and a chest portion 16*a*/16*b*. The back end 15*a* of the left shoulder strap 4*a* is attached to a top edge 17*a* of the back portion 12*a* of the left wing 3*a*. The back end 15*b* of the right shoulder strap 4*b* is attached to a top edge 17*b* of the back portion 12*b* of the right wing 3*b*.

In one embodiment, the underband 2, the left and right wings 3*a* and 3*b*, and the left and right shoulder straps 4*a* and 4*b* comprise a breathable fabric.

In one embodiment, the chest portion 16*a* of the left shoulder strap 4*a* has a left extension 18*a* attached to and extending along a neckline edge 22*a* of the left cup 5*a*. The chest portion 16*b* of the right shoulder strap 4*b* has a right extension 18*b* attached to and extending along a neckline edge 22*b* of the right cup 5*b*. The left extension 18*a* and the right extension 18*b* both extend into the gore area 9 of the undergarment 1. A bottom end 19*a* of the left extension 18*a* is attached to the right underband portion 6*b* in the gore area 9 of the undergarment 1. A bottom end 19*b* of the right extension 18*b* is attached to the left underband portion 6*a* in the gore area 9 of the undergarment 1.

In one embodiment, the left extension 18*a* and the right extension 18*b* both comprise an elastic material.

In one embodiment, each of the left and right cups 5*a* and 5*b* has a bottom edge 20*a*/20*b*, a side edge 21*a*/21*b*, and a neckline edge 22*a*/22*b*. As best shown in FIG. 2, the bottom edge 20*a* of the left cup 5*a* has a portion that is attached to the left underband portion 6*a* between the bottom edge 10*a* and the top edge 14*a* of the left underband portion 6*a*. This construction results in a segment 52*a* of the left underband portion 6*a* that is effectively an extension of the left cup 5*a*. This segment 52*a* is configured to rest beneath the overhang of the wearer's left breast, extending the pocket formed by the left cup 5*a*.

An additional fabric piece 53*a* can be sewn to a top edge 54*a* of the segment 52*a* to extend this pocket even more. As best shown in FIG. 2, the fabric piece 53*a* has a bottom edge 55*a* that is sewn to the top edge 54*a* of the segment 52*a*, and a side edge 56*a* that is sewn to the side edge 21*a* of the left cup 5*a*, where the left cup 5*a* meets the underarm portion 11*a*.

Figure 8:
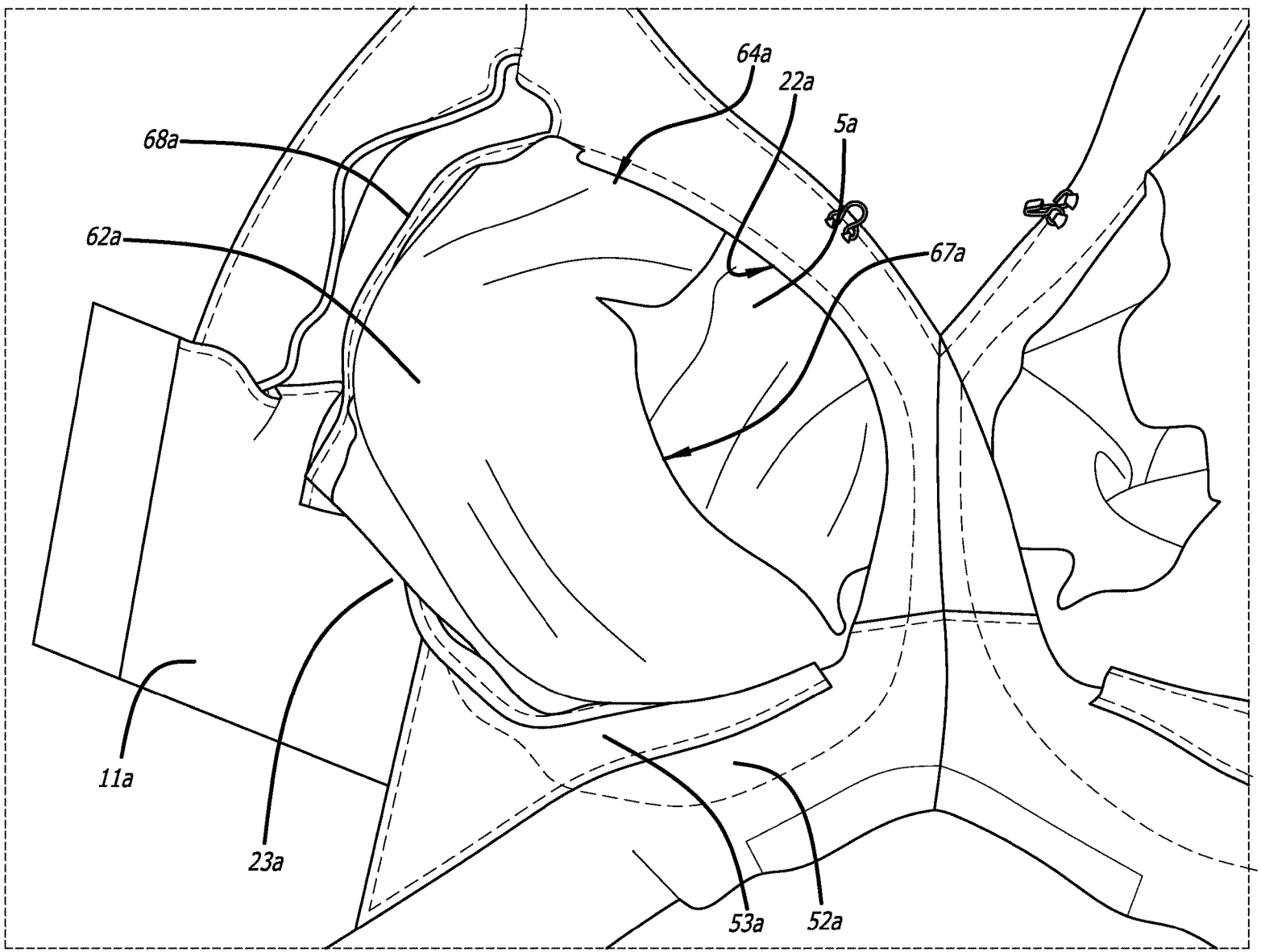
FIG. 8 is a close-up rear view of the undergarment of FIG. 1.

A cup extension piece 62*a* can be further sewn across the rear side of the left cup 5*a*, in front of the segment 52*a* and the fabric piece 53*a* to further extend the pocket formed by the left cup 5*a*. As best shown in FIGS. 2 and 8, the cup extension 62*a* is a piece of fabric that is substantially the same size and shape as the left cup 5*a*. A top edge 64*a* of the cup extension 62*a* is sewn to the neckline edge 22*a* of the left cup 5*a*. A left edge of the cup extension 62*a* is sewn to the side edge 21*a* of the left cup 5*a*, where the side edge 21*a* is attached to the front end 23*a* of the underarm portion 11*a* of the left wing 3*a*. In FIGS. 2 and 8, the left edge of the cup extension is hidden behind the fabric piece 53*a*. A bottom edge of the cup extension 62*a* is sewn to the bottom edge 20*a* of the left cup 5*a*. In FIGS. 2 and 8, the bottom edge of the cup extension is hidden behind the segment 52*a*. A right edge 67*a* of the cup extension 62*a* is left unsewn, providing an opening through which the wearer's breast can access the recess 25*a*. An armpit edge 68*a* of the cup extension 62*a* can also be left unsewn.

Similarly for the right side, the bottom edge 20*b* of the right cup 5*b* has a portion that is attached to the right underband portion 6*b* between the bottom edge 10*b* and the top edge 14*b* of the right underband portion 6*b*. This construction results in a segment 52*b* of the right underband portion 6*b* that is effectively an extension of the right cup 5*b*. This segment 52*b* is configured to rest beneath the overhang of the wearer's right breast, extending the pocket formed by the right cup 5*b*.

An additional fabric piece 53*b* can be sewn to a top edge 54*b* of the segment 52*b* to extend this pocket even more. As best shown in FIG. 2, the fabric piece 53*b* has a bottom edge 55*b* that is sewn to the top edge 54*b* of the segment 52*b*, and a side edge 56*b* that is sewn to the side edge 21*b* of the right cup 5*b*, where the right cup 5*b* meets the underarm portion 11*b*.

A cup extension piece 62*b* can be further sewn across the rear side of the right cup 5*b*, in front of the segment 52*b* and the fabric piece 53*b* to further extend the pocket formed by the right cup 5*b*. As best shown in FIG. 2, the cup extension 62*b* is a piece of fabric that is substantially the same size and shape as the right cup 5*b*. A top edge 64*b* of the cup extension 62*b* is sewn to the neckline edge 22*b* of the right cup 5*b*. A right edge of the cup extension 62*b* is sewn to the side edge 21*b* of the right cup 5*b*, where the side edge 21*b* is attached to the front end 23*b* of the underarm portion 11*b* of the right wing 3*b*. In FIG. 2, the right edge of the cup extension is hidden behind the fabric piece 53*b*. A bottom edge of the cup extension 62*b* is sewn to the bottom edge 20*b* of the right cup 5*b*. In FIG. 2, the bottom edge of the cup extension is hidden behind the segment 52*b*. A right edge 67*b* of the cup extension 62*b* is left unsewn, providing an opening through which the wearer's breast can access the recess 25*b*. An armpit edge 68*b* of the cup extension 62*b* can also be left unsewn.

In other embodiments, the segments 52*a*/52*b* and the additional fabric pieces 53*a*/53*b* can be omitted. In these embodiments, the bottom edge 20*a* of the left cup 5*a* is attached to the top edge 14*a* of the left underband portion 6*a*. The bottom edge 20*b* of the right cup 5*b* is attached to the top edge 14*b* of the right underband portion 6*b*. The side edge 21*a* of the left cup 5*a* is attached to a front end 23*a* of the underarm portion 11*a* of the left wing 3*a*. The side edge 22*b* of the right cup 5*b* is attached to a front end 23*b* of the underarm portion 11*b* of the right wing 3*b*. The neckline edge 22*a* of the left cup 5*a* is attached to the chest portion 16*a* of the left shoulder strap 4*a*. The neckline edge 22*b* of the right cup 5*b* is attached to the chest portion 16*b* of the right shoulder strap 4*b*.

In one embodiment, the left and right cups 5*a* and 5*b* are configured as socks 24*a* and 24*b* for the breasts of the wearer, each of the socks 24*a* and 24*b* defining a recess 25*a*/25*b* into which one of the breasts of the wearer can be received. The socks 24*a* and 24*b* separate, compress, and individually lift the breasts of the wearer.

In one embodiment, the socks 24*a* and 24*b* comprise an elastic fabric. In particular embodiments, the elastic fabric is nylon or spandex. In another embodiment, the elastic fabric is a textile having a spandex component in it. In a further embodiment, the elastic fabric is a stretchable textile comprising cotton, modal, or polyester.

In one embodiment, the elastic fabric of the socks 24*a* and 24*b* has a straight grain. The straight grain of the elastic fabric is oriented vertically to assist in lifting the breasts of the wearer. In other embodiments, the grain of the elastic fabric may be oriented in a direction other than vertical.

As shown for example in FIG. 2, a hook 57 may be sewn proximate a top edge 58*b* of the right extension 18*b* near the gore area 9, and an eye 59 may be sewn proximate a top edge 58*a* of the left extension 18*a*, also near the gore area 9. The hook 57 and the eye 59 may be positioned 1 to 2 inches from the point 60 at which the top edge 58*a* of the left extension 18*a* meets the top edge 58*b* of the right extension 18*b* in the gore area 9, and more preferably 1.25 to 1.75 inches from the point 60, and most preferably approximately 1.5 inches from the point 60. The hook 57 may be engaged with the eye 59 in order to pull together the left and right extensions 18*a* and 18*b*, and thus to pull together and up the left and right breasts of the wearer. This can improve the look of the undergarment.

Figure 9:
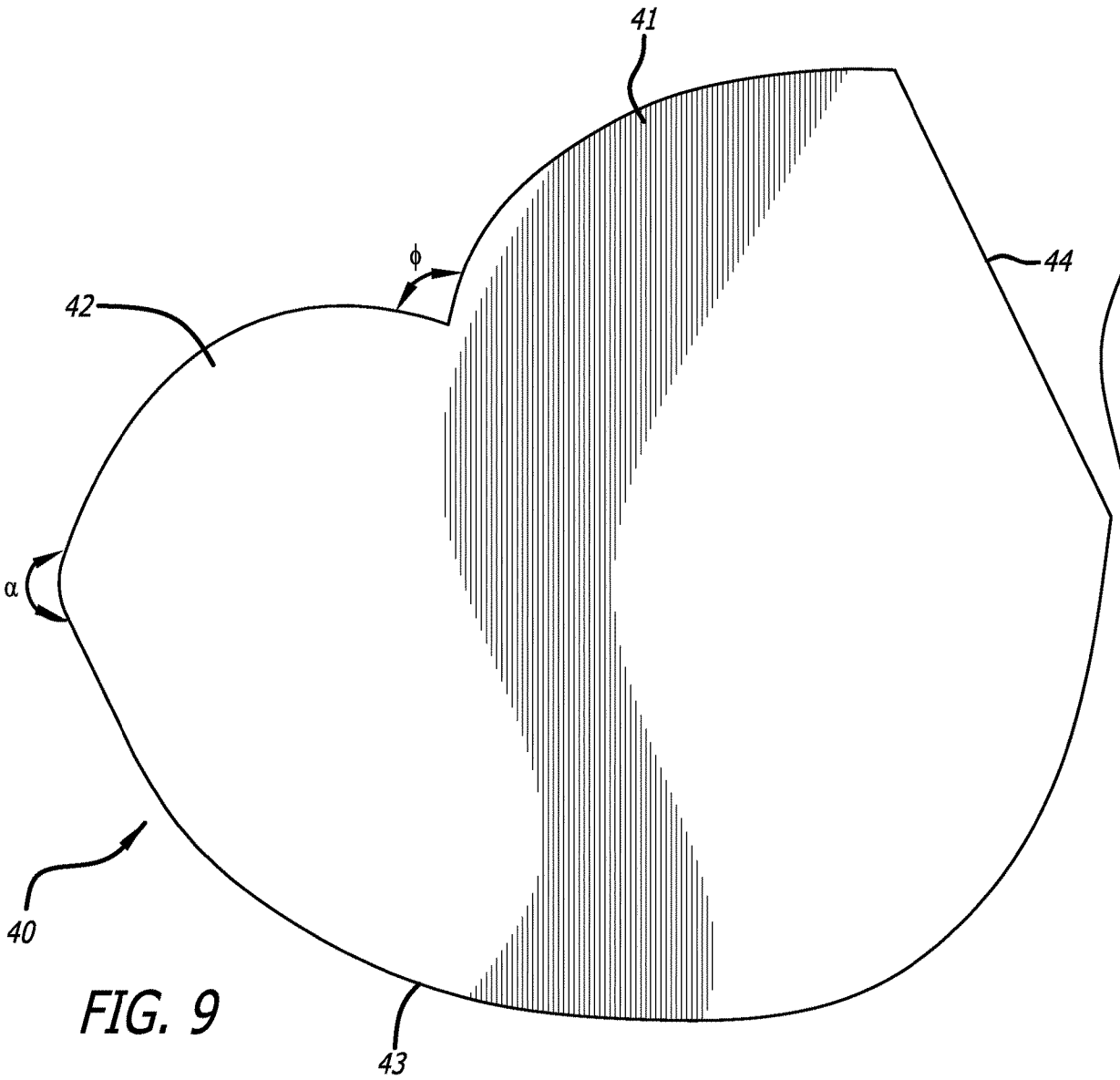
FIG. 9 is a plan view of an unsewn cup for an undergarment in accordance with one embodiment of the technology described herein.

With reference to FIG. 9, there is shown an unsewn cup 40 having an elastic fabric according to an embodiment of the disclosed technology. The elastic fabric comprises a first outwardly curved edge 41, a second outwardly curved edge 42 extending at an angle $\phi$ less than 180 degrees from the first outwardly curved edge 41, a third outwardly curved edge 43 extending at an angle $\alpha$ greater than 180 degrees from the second outwardly curved edge 42, and one or more substantially straight edges 44 connecting the third outwardly curved edge 43 to the first outwardly curved edge 41. The first outwardly curved edge 41 and the second outwardly curved edge 42 are substantially equal in length. Other shapes for the cup are also within the scope of the present disclosure.

Figure 10:
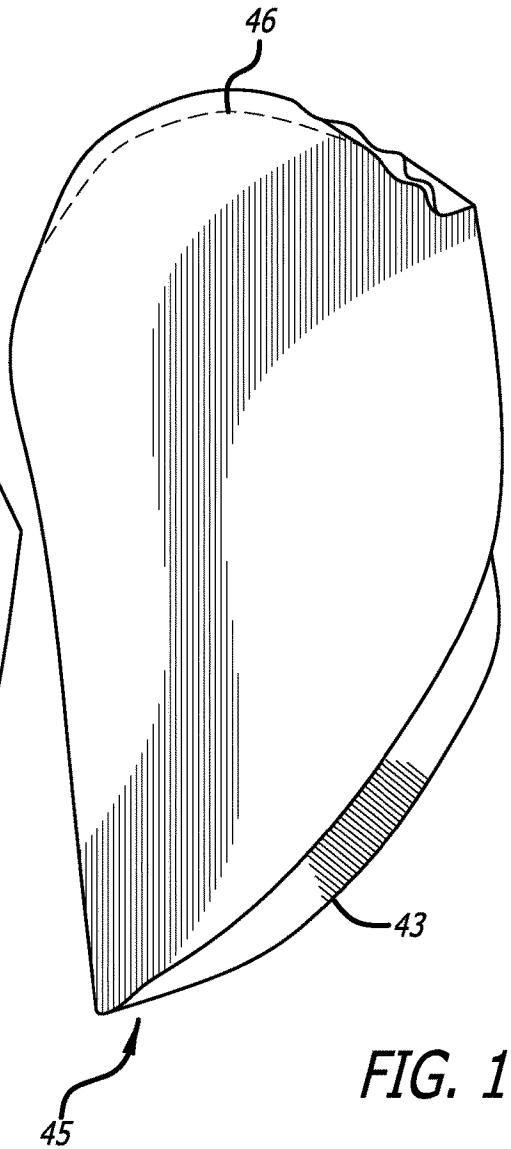
FIG. 10 is a plan view of a partially sewn cup for an undergarment in accordance with one embodiment of the technology described herein.

With reference to FIG. 10, there is shown a partially sewn cup 45 having an elastic fabric according to an embodiment of the disclosed technology. In FIG. 10, the first outwardly curved edge 41 and the second outwardly curved edge 42 are at least partially sewn together to create a seam 46. As shown for example in FIGS. 3-6, the seam extends from a central portion to the neckline edge of one of the left or right cups 5*a* and 5*b*.

A second seam 61 may be formed on each of the left and right cups 5*a* and 5*b*. As shown for example in FIGS. 3-6, the second seam 61 is positioned closer to the gore area 9 than the seam 46. The second seam 61 extends substantially parallel to the seam 46 from a central portion to the neckline edge of the cup, proximate the point 60 at which the top edge 58*a* of the left extension 18*a* meets the top edge 58*b* of the right extension 18*b* in the gore area 9.

In one embodiment, the cups of the undergarment may be single-layered. In another embodiment, the cups of the undergarment may be double-layered. In either embodiment, a top layer may be added to cover the seam 46.

Figure 13:
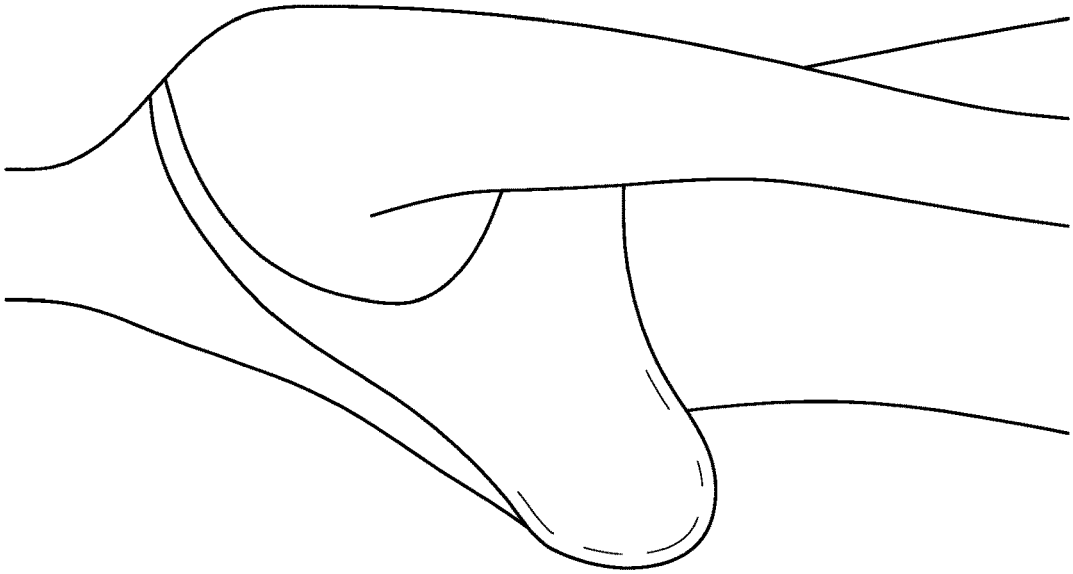
FIG. 13 is a left elevational view of prior-art comfort bra.
Figure 12:
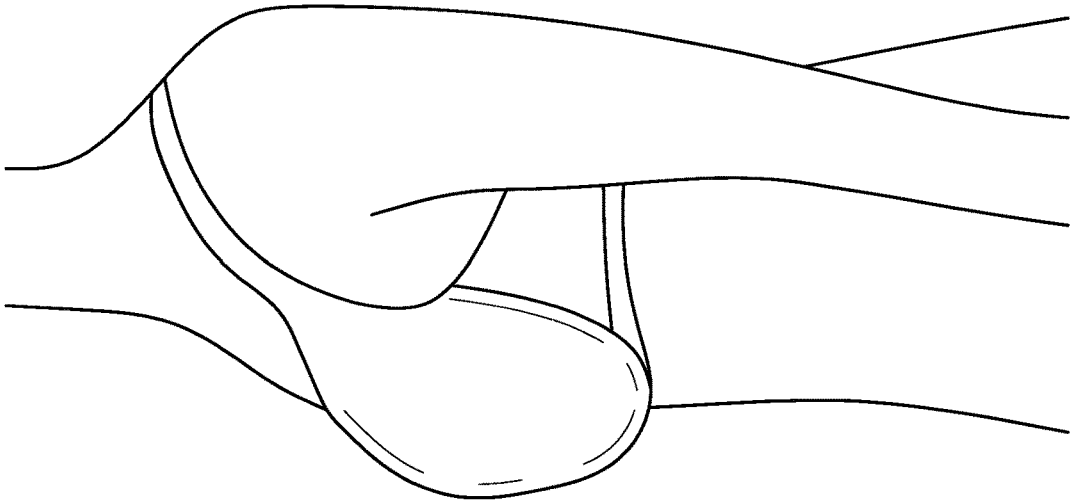
FIG. 12 is a left elevational view of a prior-art sports bra.
Figure 11:
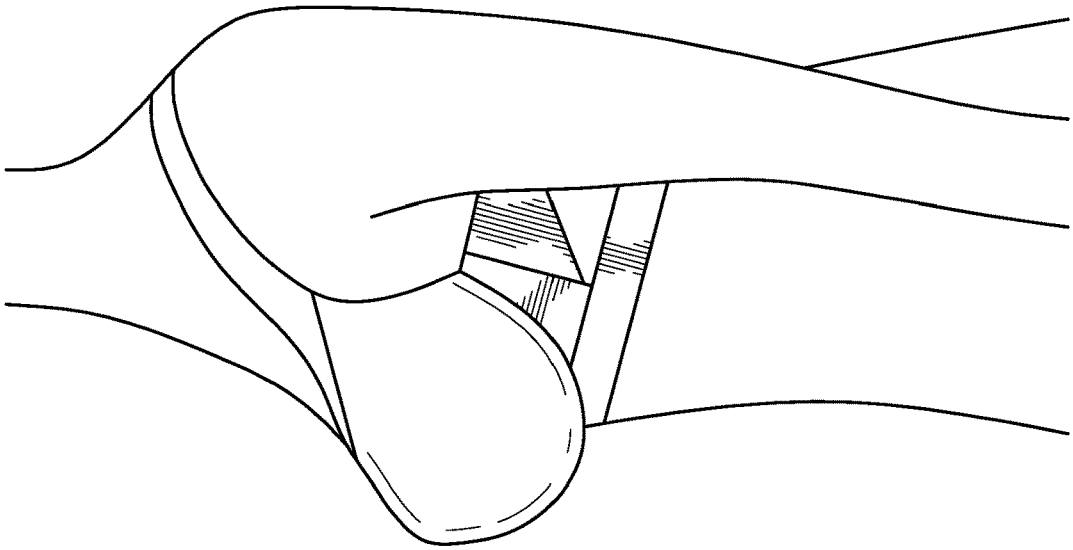
FIG. 11 is a left elevational view of an undergarment in accordance with one embodiment of the technology described herein, depicted as worn by a model.

FIGS. 11-13 are left elevational views of: (1) an undergarment in accordance with one embodiment of the technology described herein (FIG. 11); (2) a prior-art sport bra (FIG. 12); and (3) a prior-art comfort bra (FIG. 13). As shown in the figures, the sports bra (FIG. 12) undesirably smashes the breasts across the chest. The comfort bra (FIG. 13) undesirably fails to "perk up" the breasts. In contrast, the undergarment according to the technology described herein perks up the breasts and separates them, resulting in a more comfortable fit and a more flattering profile.

The term "substantially" as used throughout this disclosure, including the claims, is used to describe and account for small fluctuations. For example, the term "substantially" can refer to less than or equal to ±25%, less than or equal to ±20%, less than or equal to ±15%, less than or equal to ±10%, less than or equal to ±5%, less than or equal to ±2%, less than or equal to ±1%, less than or equal to ±0.5%, less than or equal to ±0.2%, less than or equal to ±0.1%, or less than or equal to ±0.05%.

Although the disclosed technology is described above in terms of various exemplary embodiments and implementations, it should be understood that the various features, aspects, and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

What is claimed is:

1. An undergarment comprising:

an underband comprising:

a left underband portion, and a right underband portion, wherein each of the left underband portion and the right underband portion has a gore end and a closure end, and wherein the gore end of the left underband portion and the gore end of the right underband portion meet at a gore area of the undergarment;

left and right shoulder straps, wherein each of the left and right shoulder straps has a back end and a chest portion; and left and right cups, each of the left and right cups having a bottom edge, a side edge, and a neckline edge, wherein the bottom edge of the left cup is attached to a top edge of the left underband portion, wherein the bottom edge of the right cup is attached to a top edge of the right underband portion, wherein the neckline edge of the left cup is attached to the chest portion of the left shoulder strap, wherein the neckline edge of the right cup is attached to the chest portion of the right shoulder strap, wherein the left and right cups are configured as socks for the breasts of the wearer, such that each of the left and right cups defines a stretchable sling or pocket into which one of the breasts of the wearer can be received inserted; and wherein each of the socks is formed from an elastic fabric that, prior to sewing, comprises:

a first outwardly curved edge, a second outwardly curved edge extending at an angle less than 180 degrees from the first outwardly curved edge, a third outwardly curved edge extending at an angle greater than 180 degrees from the second outwardly curved edge, and one or more substantially straight edges connecting the third outwardly curved edge to the first outwardly curved edge.

2. The undergarment of claim 1, wherein the undergarment is wireless.

3. The undergarment of claim 1, wherein:

a bottom edge of the left underband portion bends upwardly in a region beneath the left cup; and a bottom edge of the right underband portion bends upwardly in a region beneath the right cup.

4. The undergarment of claim 1, wherein a bottom edge of the underband forms a "V" shape in the gore area of the undergarment.

5. The undergarment of claim 1, further comprising left and right wings, each of the left and right wings comprising:

an underarm portion; and a back portion;

wherein:

the back portion of the left wing extends at an angle from the underarm portion of the left wing, forming an acute angle with the left underband portion;

the back portion of the right wing extends at an angle from the underarm portion of the right wing, forming an acute angle with the right underband portion; and the back portion of the left wing and the back portion of the right wing are configured to be releasably fastened together.

6. The undergarment of claim 5, wherein, when the undergarment is worn, a gap is defined between the underband and a fastening area of the back portions of the left and right wings.

7. The undergarment of claim 1, wherein the underband and the left and right shoulder straps comprise a breathable fabric.

8. The undergarment of claim 1, wherein:

the chest portion of the left shoulder strap has a left extension attached to and extending along the neckline edge of the left cup; and the chest portion of the right shoulder strap has a right extension attached to and extending along the neckline edge of the right cup.

9. The undergarment of claim 8, wherein the left extension and the right extension both comprise an elastic material.

10. The undergarment of claim 8, wherein the left extension and the right extension both extend into the gore area of the undergarment.

11. The undergarment of claim 10, wherein:

a bottom end of the left extension is attached to the right underband portion in the gore area of the undergarment; and a bottom end of the right extension is attached to the left underband portion in the gore area of the undergarment.

12. The undergarment of claim 1, wherein the socks are configured to separate the breasts of the wearer.

13. The undergarment of claim 1, wherein the socks are configured to individually lift the breasts of the wearer.

14. The undergarment of claim 1, wherein the socks are configured to compress the breasts of the wearer.

15. The undergarment of claim 1, wherein the elastic fabric is nylon.

16. The undergarment of claim 1, wherein the elastic fabric is spandex.

17. The undergarment of claim 1, wherein:

the elastic fabric of the socks has a straight grain; and the straight grain of the elastic fabric is oriented vertically to assist in lifting the breasts of the wearer.

18. The undergarment of claim 1, wherein:

the first outwardly curved edge and the second outwardly curved edge are substantially equal in length and are at least partially sewn together to create a seam; and the seam extends from a central portion to the neckline edge of one of the left or right cups.

* * * * *